US005243326A

United States Patent [19]

Disabato

[11] Patent Number: 5,243,326

[45] Date of Patent: Sep. 7, 1993

[54] DEVICE FOR PROTECTING COMPONENTS OF SECURITY SYSTEMS AGAINST OBSTRUCTION

[75] Inventor: Vito Disabato, Collegno, Italy

[73] Assignee: Elkron S.p.A., Turin, Italy

[21] Appl. No.: 776,808

[22] Filed: Oct. 15, 1991

[30] Foreign Application Priority Data

Oct. 19, 1990 [IT] Italy ..... 67805 A/90

[51] Int. Cl.[5] ..... G08B 13/18

[52] U.S. Cl. ..... 340/555; 250/221; 340/309.15; 340/693

[58] Field of Search ..... 340/555, 567, 568, 550, 340/521, 506, 603, 693, 309.15; 250/221, 342, 353; 324/706

[56] References Cited

U.S. PATENT DOCUMENTS 4,797,548 1/1989 Köbbing et al. ..... 340/555 X

FOREIGN PATENT DOCUMENTS 0078443 11/1983 European Pat. Off. .
0186226 2/1986 European Pat. Off. .
0289621 9/1988 European Pat. Off. .
2141228 12/1984 United Kingdom ..... 340/555

OTHER PUBLICATIONS

European Search Report; Appln. No. EP 91 83 0439.

*Primary Examiner*—John K. Peng
*Assistant Examiner*—Thomas J. Mullen, Jr.
*Attorney, Agent, or Firm*—Fish & Richardson

[57] ABSTRACT

An element of an intrusion-alarm system, for example a passive infra-red sensor, has two subsystems which protect it against obstruction. The first subsystem can detect attempts at obstruction by the removal of the lens or front screen of the element or by the spraying of the element with a spray or a lacquer. The second subsystem projects, towards the area under surveillance, radiation which can be reflected by a masking screen. The detection of this reflected radiation gives rise to the emission of a warning signal.

24 Claims, 2 Drawing Sheets

DEVICE FOR PROTECTING COMPONENTS OF SECURITY SYSTEMS AGAINST OBSTRUCTION

FIELD OF THE INVENTION

The present invention relates to device for protection against obstruction (masking) and has been developed with particular attention to its possible use in the field of intrusion-alarm systems (burglar alarms).

More specifically, the present invention relates to the problem of protecting against obstruction the parts of the alarm system (for example, the infra-red sensors, that is, the so-called pyroelectric sensors, or elements such as sirens and the like) which have external surfaces open to attempted obstruction. Such a surface may be defined, for example, by a so-called radome or by a lens such as, for example, a Fresnel lens for directing the infra-red rays coming from the detection area onto the sensitive element of the sensor. A sensor having these characteristics is described, for example, in European patent application EP-A-O 255 812 in the name of the present Applicant.

In the case of an element such as a siren, instead of a screen, the surface may be the imaginary surface of one or more sound-emitting holes.

PRIOR ART—THE PROBLEMS UPON WHICH THE INVENTION IS BASED

Infra-red sensors have considerable functional and applicational advantages in comparison with other technical solutions currently used in surveillance systems. They are, however, vulnerable to obstruction (masking) carried out by the positioning of highly absorbent media (panels of wood, cardboard, or light-absorbent materials such as foamed materials) in front of the sensor, or with the use of materials which end up in contact with the surface of the front screen such as, for example, lacquers, sprays or paints sprayed onto the screen from a distance, or gaseous substances which solidify on the surface of the screen of the sensor after several hours, rendering it practically insensitive because the sprayed material reflects or absorbs most of the radiation used for the detection.

One of the greatest difficulties encountered in providing sensors of this type with means for protecting them against obstruction or masking lies in the fact that, in many cases, in order to prevent the sensor from perceiving a phenomenon inherent in its normal useful life as an attempt to obstruct or mask it, the sensor (and, more particularly, the circuits associated therewith) must have a certain ability to adapt to certain parameters which change slowly over a period of time. This means, however, that if the obstruction is carried out particularly skillfully and very slowly, the sensor can be masked completely without being able to supply any useful indication of the masking.

OBJECTS AND SUMMARY OF THE INVENTION

The object of the present invention is, therefore, to provide a device for protection against obstruction which is intrinsically immune to attempted obstruction or masking by the positioning of highly absorbent materials a certain distance in front of the sensor in the detection area covered thereby, by the spraying of sprays, lacquers, paints, or gaseous substances, etc. onto the screen (the radome or the lens), or even by the removal of the screen, and is also immune to any attempts at obstruction which may be carried out against other elements of the security system. In particular, the object of the present invention is to provide a device which is also substantially immune to attempts very slowly to mask it.

According to the present invention, this object is achieved by virtue of a device having the specific characteristics claimed in the following claims.

BRIEF DESCRIPTION OF THE DRAWINGS

The invention will now be described, purely by way of non-limiting example, with reference to the appended drawings, in which.

DETAILED DESCRIPTION OF THE INVENTION

Figure 1:
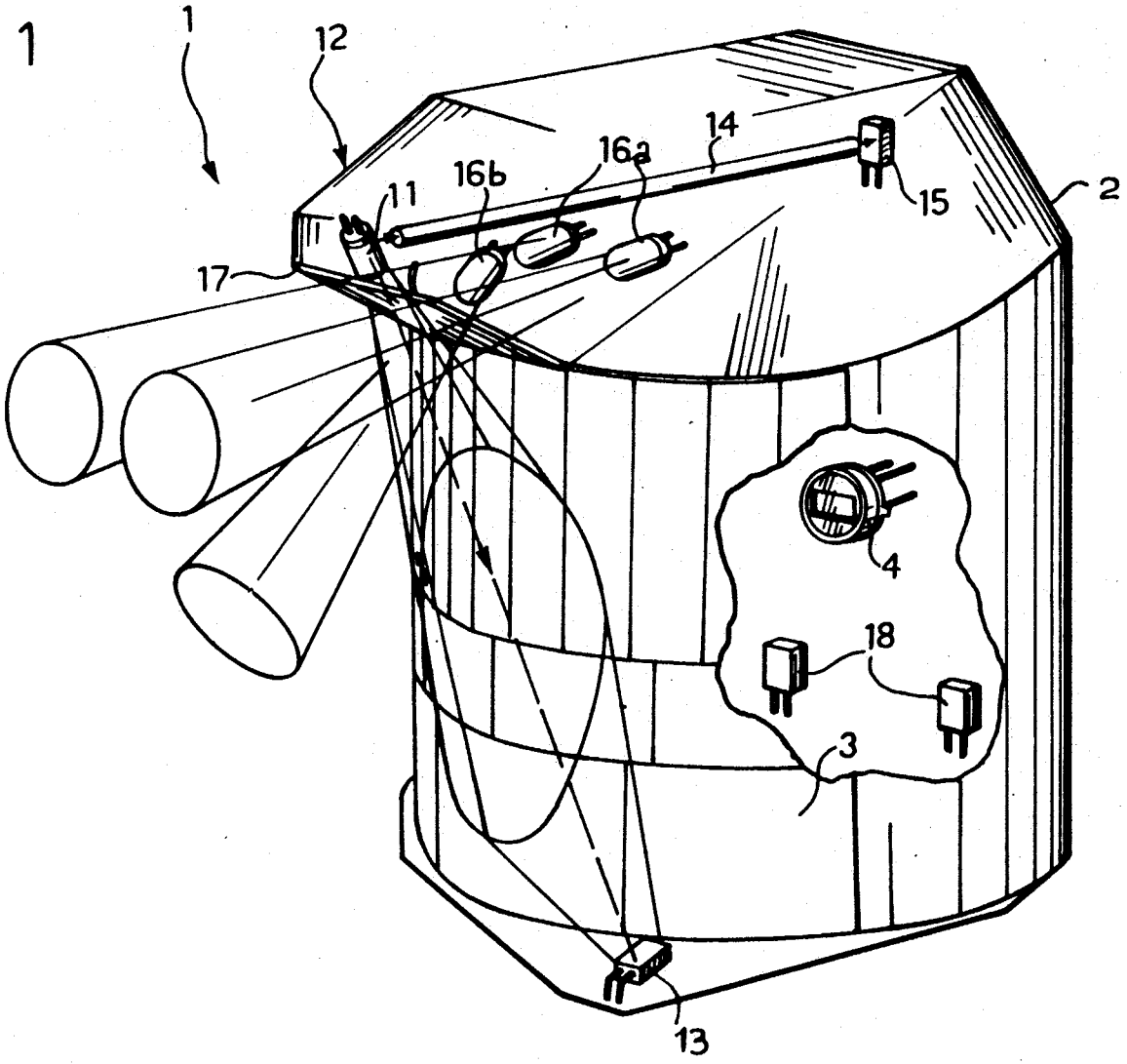
FIG. 1 is a partially cut-away perspective view of a sensor with a device according to the invention for protecting it against obstruction.

In the view of FIG. 1, a sensor, generally indicated 1, is intended to form part of an intrusion-alarm system (a burglar alarm) for the surveillance of an area or a group of areas.

For this purpose, the device has a housing 2 so that it can be fixed to one of the walls of the area under surveillance, if necessary, with the interposition of a bracket. The portion of the housing 2 which is intended to face the detection zone (that is, the area under surveillance) has a front wall defined by a screen 3. The screen is transparent to the radiation used for the detection (typically infra-red radiation in the range of wavelengths between, for example, 0.8 and 15 $\mu$) and which thus has the characteristics of a radome or, preferably, a lens which can pick up the infra-red rays from several regions of the area under surveillance and focus them onto the sensitive element (the pyroelectric detector) 4 of the sensor.

The detection signal produced by the element 4 indicates the presence of intruders in the area so that alarm signals can be emitted when the system is activated.

The general criteria for the construction of the sensor 1, particularly as regards the construction of the screen 3, the relative positioning of the sensitive element 4, and the processing of the signals generated thereby are widely known in the art and do not therefore need to be recited specifically herein.

As already indicated above, the invention relates in particular to the problem of making the sensor 1 immune to attempts to obstruct (or mask) it by:

the positioning of absorbent panels (panels of wood, cardboard, sound-absorbent panels, etc.) in front of the outer front surface of the sensor 1 (the surface defined by the screen 3 which is interposed between the sensitive element 4 and the detection zone and through which the infra-red detection radiation which strikes the element 4 is therefore intended to pass) usually at a certain distance therefrom so as, on the one hand, to obstruct the field of view of the sensor completely and, on the other hand, to reflect towards the sensor only a very small amount of any radiation emitted thereby in order to detect the presence of an obstacle in the area under observation, and/or the spraying onto the screen 3, or onto any front window of the element under attack, of substances such as sprays, lacquers, paints, gaseous substances, etc. so as to render the front surface (the screen 3) substantially opaque, that is, not transparent, to the radiation used for the detection.

According to the invention, protection against attempted masking or obstruction (which as already stated may also be carried out against other elements, such as a siren, by trying to surround it in a casing or to block the holes through which the sound is emitted) is achieved with the use of two separate subsystems.

The first subsystem comprises essentially a source of radiation, typically an LED 11 operating in the infrared range, mounted in an appendage 12 which projects from the housing 2 in a position such that it does not interfere with the field of observation defined by the lens 3. In practice, if, as in the embodiment illustrated, the sensor 1 is generally semicylindrical, the appendage 12 constitutes a sort of "lump" which projects diametrally from the centre of the top of the housing above the lens 3. The LED 11 can thus project its radiation through the lens 3, generally obliquely relative to the surface thereof, from outside the housing, so that it falls on a first photodetector (for example, a photodiode or a phototransistor) 13 generally arranged in the lower portion of the housing 2, that is, on the opposite side of the lens 3 from the LED 11. In particular, the photodetector 13 is disposed in the lower portion of the housing 2 in a position generally screened from the outside environment so as not to be affected by interference from any external infra-red sources (for example, remote controls, etc.).

At the same time, the radiation emitted by the LED 11 is also transmitted through a duct 14 (usually constituted simply by a hole in a wall of the housing 2) towards a photodetector 15, also constituted by a photodiode or a phototransistor.

The second subsystem for protection against masking or obstruction is constituted by a further source 16 constituted by a pair of radiation emitters (also infra-red LEDS) 16*a* side by side in generally symmetrical positions relative to the housing 2 and a third emitter (an LED) 16*b* in a central position between the two LEDS 16*a*. More precisely, the LEDS 16*a* are arranged so as to project their radiation in a plane which is substantially perpendicular to the plane of the screen 3 (that is, generally forwardly of the sensor 2) whilst the central LED 16*b* projects its radiation obliquely downwardly.

To enable this functional arrangement, the appendage 12 on the front of the housing 2 has a lower window 17 which is inclined at about 45° to the vertical plane defined by the screen 3 so that both the radiation projected by the LED 11 towards the photoelectric sensor 13 and the radiation projected by the LEDS 16*a* and 16*b* towards the space in front of the sensor 1 can pass through it.

The LED 11 and the LEDS 16*a* and 16*b* are located very close together in the appendage 12 so that any attempt to neutralise one of the subsystems for preventing obstruction necessarily results in an attempt to neutralise the other subsystem as well, resulting in the emission of an alarm signal.

Still in the perspective view of FIG. 1, a further photoelectric sensor, indicated 18, is constituted by a single photodiode or phototransistor or, possibly, a pair of such devices located symmetrically relative to the housing 2.

The sensor(s) 18 is (are) behind the lens 3, generally below the sensitive element 4, so as to be able to pick up any of the radiation generated by the LEDS 16*a* and 16*b* which is reflected towards the sensor 1 as a result of the positioning of a masking screen P in front of it.

Naturally, the wavelength or emission spectrum of the LED 11 and the sensitivity curves of the photodetectors 13 and 15—on the one hand—and the emission spectra of the LEDS 16*a* and 16*b* and the sensitivity curve of the photodetector 18—on the other hand—are selected so as to give rise to selective coupling within each source-detector pair, so that the detection carried out by the photodetectors is not affected by ambient light or by the radiation used for the intrusion detection carried out by the sensitive element 4.

By way of example, one might consider LEDS 11, 16*a* and 16*b* operating at a wavelength of the order of 800–1000 nanometers with corresponding photodetectors.

As will be made clearer below with reference to the block diagram of FIG. 2, the two subsystems described above for protection against masking are intended to operate within separate time intervals; this excludes, under all circumstances, the possibility of the LEDS 16*a* and 16*b* interfering with the detection carried out by the photodetectors 13 and 15 or, conversely, of the LED 11 interfering with the detection carried out by the photodetector 18. However, the activation of the subsystems for protection against masking does not in any case interefere with the surveillance function of the pyroelectric sensor 4 which can be kept active even during the tests for obstructions. The function of protection against obstruction, therefore, does not interrupt the surveillance function.

Figure 2:
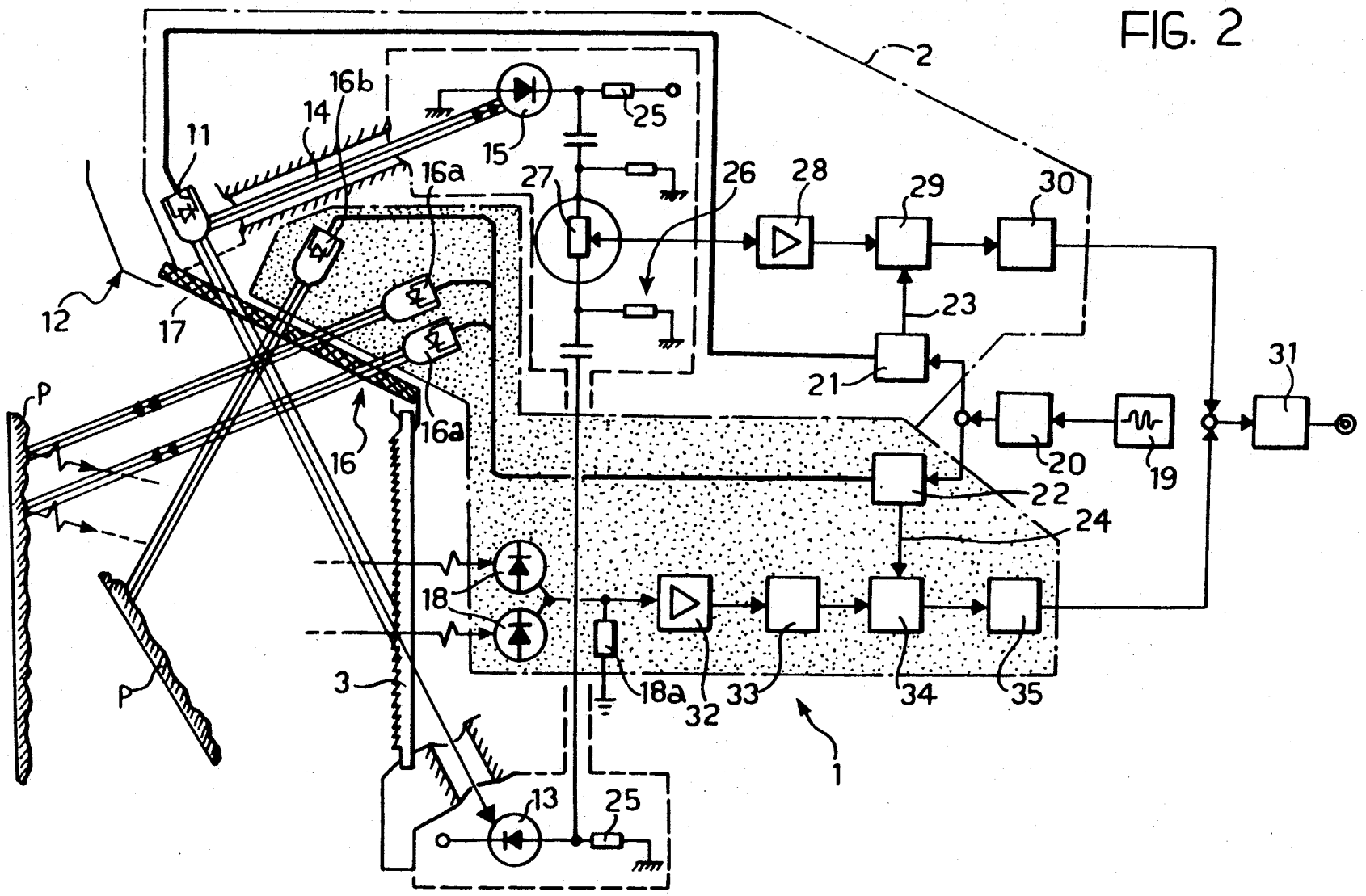
FIG. 2 shows in the form of a block diagram the general structure of the circuit portion of the device according to the invention.

The block diagram of FIG. 2 shows the various emitters and receivers shown in FIG. 1 with their electrical connections. It will be appreciated that the block diagram of FIG. 2 shows neither the photosensitive element 4 nor the circuits associated therewith; in fact, these elements can be formed in known manner and therefore do not need to be described in detail herein.

In the block diagram of FIG. 2, a timer, indicated 19, has the function of periodically activating the obstruction (masking) protection function of the device according to the invention.

The frequency with which the test is repeated can be varied selectively (by acting—in known manner—on the timer 19) according to the level of security to be attributed to the sensor 1 and, consequently, to the system of which it forms a part. Usually, for systems with high security levels, the test can be carried out very frequently, for example, with a few seconds separating one test and the next. The device according to the invention is also suitable, however, for carrying out the obstruction protection function continuously, as may be necessary in applications for which a very high level of security is required. This is done without interrupting the surveillance.

A synchronising circuit 20 arranged in cascade with the timer 19 has the function of causing the following two tests to be carried out alternately during the test interval established by the timer 19:

the detection of any attempted obstruction by the spraying of substances onto the lens 3 or the removal of the lens itself (the LED 11 and the components associated therewith), the detection of the presence of any absorbent panel P in front of the sensor 1 (the LEDS 16*a* and 16*b* and the components associated therewith).

In view of the extreme rapidity with which each individual test cycle is effected, the two tests can alternate at a high frequency (even in the kHz range). In this connection, each test interval may allow for an individual test to be repeated a large number of times (even several hundred times), a signal warning of an attempted obstruction being emitted only when all the tests give a positive result in this respect.

Clearly, the object of this is to prevent wholly incidental phenomena (for example, an insect passing by or settling momentarily on the lens 3) giving rise to an unjustified alarm.

In any case, as is well known to an expert in the art, there are many ways in which the results of the tests can be processed and used and the processing strategy can be modified in dependence on the particular requirements of use.

Two piloting circuits, indicated 21 and 22, are controlled by the synchronising circuit 20, whose function is essentially to activate respectively:

the LED 11 with the emission of a corresponding enabling signal, whose function will be explained further below, on a synchronising line 23, and the LEDS 16*a* and 16*b* with the emission of a corresponding enabling signal, whose function will also be explained further below, on a synchronising line 24.

As can be seen in the upper portion of FIG. 2, the photodetectors 13 and 15 associated with the LEDS 11 are interconnected in a bridge arrangement of which the photodetectors 13 and 15 constitute opposite arms, the other two arms being constituted by resistors 25.

The two outputs of the bridge are sent to a balancing unit 26 which is connected to an externally adjustable potentiometer 27 whose movable rheophore is connected to the input of an amplifier 28. The output of the amplifier is sent through a circuit 29 constituted by an analog switch which is closed as a result of the receipt of a synchronising signal emitted on the line 23 by the circuit 21 for a period of time of predetermined length starting at the moment when the circuit 21 activates the LED 11. For this purpose, the circuit 21 may include a delay function which, like the duration of the sensitivity window determined by the closure of the analog switch 29, may be adjustable. The signal output by the switch 29 is sent through a threshold circuit 30 and is then sent to an alarm-signal processing circuit 31 which is also connected, in a general "wired-OR" arrangement, to the other masking detection subsystem connected to the LEDS 16*a* and 16*b*. This subsystem includes an amplifier 32 connected to the output of the photodetector 18 by a polarising resistor 18*a*, the output of the amplifier 32 passing through a first threshold circuit 33 to another analog switch 34 which is controlled by the circuit 22, in a manner substantially similar to that in which the circuit 21 controls the switch 29, and then passes through a further threshold circuit 35 to the alarm-processing circuit 31.

The first detection subsystem (the one connected to the LED 11) is calibrated initially by means of the potentiometer 27, so that when the device 1 is functioning correctly (that is, with the lens 3 mounted correctly on the housing 2 and clean, that is, not blocked by lacquers, sprays, paints, etc.), the bridge formed by the photodetectors 13 and 15 and the resistors 25 and by the circuit 26 is completely balanced, so that it does not give rise to an appreciable output signal to the threshold circuit 30 when the LED 11 is activated.

In practice, this corresponds to the establishment of a predetermined relationship between the outputs of the photodetectors 13 and 15.

This relationship or balance is completely independent of the emission characteristics of the LED 11 so that phenomena such as any variation in the emission characteristics of the LED 11 as a result of ageing or changes in environmental parameters have no effect on the behaviour of the device. This also applies to the different emission characteristics of LEDS 11 used to produce devices of a certain batch.

The characteristics of the propagation of the radiation from the LED 11 towards the photodetector 15 through the duct 14 (which is concealed within the housing 2 and thus protected from external phenomena) are also practically invariable with time.

This means that, in practice, the only phenomena which can lead to an imbalance in the circuit are phenomena which change the characteristics of the propagation of the radiation of the LED 11 to the photodetector 13 through the surface defined by the lens 3; naturally this expression—which is used in the claims includes both attempts to mask the sensor by spraying sprays, paints, lacquers, etc. onto the lens, screen or window defining the surface 3, and any removal of the element defining the surface 3 of the housing 2. In fact such tampering causes a change in the attenuation characteristics of the path along which the radiation is propagated from the LED 11 to the photodetector 13 and a corresponding imbalance in the bridge circuit causing the generation of a signal which, if it exceeds the threshold level set in the circuit 30, causes the the circuit 31 to emit an alarm signal.

The function of the analog switch 29 is essentially to take account of any variation with time of the characteristics of the response demonstrated by the photodetectors 13 and 15 when they are struck by the pulse of radiation emitted by the LED 11; it is usually found that these responses may differ slightly, particularly in correspondence with their leading edges; for this reason, the switch 29 is controlled by the circuit 21 by means of the line 23 so as to open and enable the signal generated by the sum, in phase opposition, of the responses of the photodetectors 13 and 15 to the pulse to pass to the threshold circuit 30 only a certain time after the LED 11 is activated.

For example, assuming that the LED 11 is activated by a pulse lasting 30 microseconds, the switch 29 may be intended to close about 10 microseconds after the leading edge of the pulse for activating the LED 11 so as to give rise to an observation window lasting about 20 microseconds. In any case, the delay and the duration of the observation window determined by the switch 29 can easily be calibrated in dependence on the components used by observing the differential signal input to or output from the amplifier 28, for example on an oscilloscope.

In any case, it will be noted that the subsystem connected to the LED 11 takes as its reference a condition of static equilibrium which is fixed once and for all when the device is calibrated, and not a dynamic reference which could give rise to changes over a period of time which would make masking attempts carried out skillfully and very slowly impossible to detect.

As indicated above, the test relating to the presence of any absorbent screens P in front of the device is carried out under the control of the circuit 20 during intervals which alternate with those in which the test described above is carried out. This is to prevent any cross-over effect between the two tests.

In this case, the respective subsystem is adjusted, for example, by means of the resistor 18*a* or by altering the gain of the amplifier 32 so that the detection signal from the photodetector 18 exceeds the threshold level set in the circuit 33 only when an obstacle P is located in front of the sensor 1 so as to mask it; this situation can be reproduced very precisely during the calibration of the device. In particular, the use of several LEDS (the pair 16*a* constituted by two LEDS connected in series and the third LED 16*b* connected in parallel) enables the power of the radiation emitted into the area to be quite high (so that any corresponding reflected signal is sure to be distinguishable even if the screen P is made of very absorbent material, for example, foam, etc.) and at the same time enables the entire space within the field of view before the sensor 1 to be covered. In particular, this thwarts any attempts at obstruction carried out by approaching the sensor 1 from underneath, that is from below.

The comparison levels of the threshold circuits 33 and 35 of this subsystem are also absolute in character and are not subject, over a period of time, to changes which would enable masking or obstruction to be achieved by operating slowly. The function of the switch 34 is substantially like that of the analog switch 29 described above, that is, essentially to ensure that an observation window for any signal emitted by the photodetector 18 as a result of the activation of the emitters 16*a* and 16*b* is opened within a well-defined time interval after the sources 16*a* and 16*b* have been excited. In fact, the response of the photodetector 18 to the pulse may have a peak in correspondence with its leading edge and then settle gradually to an approximately steady value; it is generally preferable for the observation to be made in these settled conditions. In any case, the comparator circuit 33 prevents small-amplitude signals due to interference or other spurious phenomena from being propagated to the switch 34 so that the comparator 35 downstream can in fact operate on signals which have a high probability of corresponding to a masking attempt.

The "wired-OR" configuration in which the two subsystems are connected to the circuit 31 ensures that a signal warning of an attempted obstruction is emitted whatever the nature of the attempt.

Naturally, the principle of the invention remaining the same, the details of construction and forms of embodiment may be varied widely with respect to those described and illustrated, without thereby departing from the scope of the present invention.

What is claimed is:

1. A device for protecting against obstruction of an element of a security system, said device comprising a housing disposed generally about the element, and an external surface adapted for propagation therethrough of radiation between the element within said housing and an area external of said housing, said external surface having an outer side open to obstruction, said device further comprising:

first radiating means disposed for projecting radiation through said external surface, second radiating means for projecting radiation towards said area external of said housing of said device, in front of said outer side of said external surface, first sensing means disposed for sensing radiation emitted by said first radiating means that is projected through said external surface, said first radiating means and said first sensing means disposed on opposite sides of a plane of said external surface, and second sensing means for sensing the radiation emitted by said second radiating means and reflected towards said outer side of said external surface when an obstruction is placed in front of said outer side of said external surface, whereby, when such an obstruction is present, said second sensing means causes generation of a corresponding warning signal, said housing further comprising an appendage which projects generally beyond said plane of said external surface into a region generally at the outer side of said plane of said external surface, and said first radiating means and said second radiating means are mounted in said appendage, within said housing, whereby a change in the characteristics of the propagation of the radiation through said external surface causes generation of a corresponding warning signal.

2. A device according to claim 1 wherein said external surface comprises an external surface of a lens of said element.

3. A device according to claim 2, wherein the lens is a Fresnel lens.

4. A device according to claim 1, wherein said element comprises a pyroelectric member sensitive to electromagnetic radiation in the infra-red range.

5. A device according to claim 5, wherein the member is sensitive to radiation whose wavelength is substantially within the range of from 5 to 15 $\mu$.

6. A device according to claim 1, wherein said first radiating means and said second radiating means each comprise at least one radiation-emitting diode operating in the infra-red range.

7. A device according to claim 1, wherein said first radiating means are disposed within said housing, generally above said external surface.

8. A device according to claim 1, wherein said first radiating means are disposed to project radiation obliquely relative to a plane of said external surface.

9. A device according to claim 1, wherein said first sensing means are located within said housing in a position which is generally screened from receiving radiation from outside the housing and passing through said external surface.

10. A device according to claim 1, wherein said first radiating means are associated with second sensing means, said second sensing means being located within said housing and relative to said first radiating means so as to directly receive and detect radiation generated by said first radiating means, without said radiation passing through said external surface, whereby the difference between the respective signals output by said first sensing means and by said second sensing means causes generation of a warning signal corresponding exclusively to changes in the characteristics of the propagation of the radiation through said external surface.

11. A device according to claim 10, wherein said device further comprises a screen disposed between said first radiating means and said second sensing means, said screen defining a hole and said second sensing means face the hole in alignment with said first radiating means.

12. A device according to claim 1, wherein said device comprises circuitry for activating the first sensing means for a selectively predetermined time interval after the first radiating means have been activated.

13. A device according to claim 1, wherein said device comprises circuitry for activating the second sensing means for a selectively predetermined time interval after the second radiating means have been activated.

14. A device according to claim 1, wherein said second radiating means include two separate sources which project radiation towards the area external of said housing, in front of said external surface, from different directions.

15. A device according to claim 14, wherein one of the sources projected radiation in a direction generally perpendicular to said plane of said external surface, and the other of the sources projects radiation in a direction generally inclined to said plane.

16. A device according to claim 14, wherein said one of the sources comprises a pair of sources which project radiation in a direction generally perpendicular to said plane.

17. A device according to claim 1, wherein the appendage has a front window disposed generally above and extending obliquely relative to said plane of said external surface and facing said first radiating means and said second radiating means.

18. A device according to claim 1, wherein said device comprises timing means for activating the first radiating means selectively at predetermined intervals.

19. A device according to claim 1, wherein said device comprises timing means for activating the second radiating means selectively at predetermined intervals.

20. A device according to claim 1, wherein said device comprises piloting means for activating the first radiating means and the second radiating means alternately.

21. A device according to claim 1, wherein said element comprises a sensing member for the surveillance of an area external of said housing, wherein the device includes timing means for activating said first radiating means and said second radiating means selectively at predetermined intervals and the sensing member is kept in operation whilst each of said first radiating means and said second radiating means are activated so that protection against obstruction is achieved without interrupting the surveillance.

22. A device for protecting against obstruction of an element of a security system, said device comprising a housing disposed generally about the element, and an external surface adapted for propagation therethrough of radiation between the element within said housing and an area external of said housing, said external surface having an outer side open to obstruction, said device further comprising:

first radiating means disposed for projecting radiation through said external surface, and first sensing means disposed for sensing radiation emitted by said first radiating means and projecting through said external surface, said first radiating means and said first sensing means disposed on opposite sides of a plane of said external surface, whereby a change in the characteristics of the propagation of the radiation through said external surface causes generation of a corresponding warning signal, and said device further comprising:

second radiating means for projecting radiation towards said area external of said housing of said device, in front of said outer side of said external surface, said second radiating means comprising two separate sources which project radiation towards the area external of said housing, in front of said external surface, from different directions, and second sensing means for sensing the radiation emitted by said second radiating means and reflected towards said outer side of said external surface when an obstruction is placed in front of said outer side of said external surface, whereby, when such an obstruction is present, said second sensing means causes generation of a corresponding warning signal.

23. A device according to claim 22, wherein one of the sources projects radiation in a direction generally perpendicular to a plane of said outer side of said external surface, and the other of the sources projects radiation in a direction generally inclined to said plane of said outer side of said external surface.

24. A device according to claim 22, wherein said one of the sources comprises a pair of sources which project radiation in a direction generally perpendicular to a plane of said outer side of said external surface.

* * * * *

UNITED STATES PATENT AND TRADEMARK OFFICE

CERTIFICATE OF CORRECTION

PATENT NO. : 5,243,326

DATED : September 7, 1993

INVENTOR(S) : Vito Disabato

It is certified that error appears in the above-identified patent and that said Letters Patent is hereby corrected as shown below:

In the claims:

Claim 5, column 8, line 33, delete "5" and insert --4--.

Claim 15, column 9, line 15, delete "projected" and insert --projects--.

Signed and Sealed this

Nineteenth Day of April, 1994

Bruce Lehman

*Attest:*

BRUCE LEHMAN

*Attesting Officer*

*Commissioner of Patents and Trademarks*